US009429401B2

(12) United States Patent
Corder et al.

(10) Patent No.: US 9,429,401 B2
(45) Date of Patent: Aug. 30, 2016

(54) PASSIVE STABILITY SYSTEM FOR A VEHICLE MOVING THROUGH A FLUID

(71) Applicant: Raytheon Company, Waltham, MA (US)

(72) Inventors: David A Corder, Tucson, AZ (US); Paul A Merems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 170 days.

(21) Appl. No.: 14/306,772

(22) Filed: Jun. 17, 2014

(65) Prior Publication Data

US 2015/0362301 A1 Dec. 17, 2015

(51) Int. Cl.

*F42B 10/64* (2006.01)
*F42B 10/02* (2006.01)
*F42B 19/01* (2006.01)

(52) U.S. Cl.

CPC ..... *F42B 10/02* (2013.01); *F42B 19/01* (2013.01)

(58) Field of Classification Search

CPC ..... F42B 15/01
USPC ..... 244/3.22, 3.24, 78.1, 82
See application file for complete search history.

(56) References Cited

U.S. PATENT DOCUMENTS 3,986,475 A * 10/1976 Heiser ..... B63H 25/12 114/144 R
4,050,651 A * 9/1977 Neal ..... B64C 3/14 244/15
4,432,512 A * 2/1984 Young ..... F42B 10/666 239/265.19
4,667,899 A * 5/1987 Wedertz ..... F42B 10/14 244/218
4,804,154 A * 2/1989 Davis ..... G01M 9/06 244/1 R
4,913,379 A * 4/1990 Kubota ..... F42B 10/60 239/265.35
4,927,096 A * 5/1990 Kranz ..... F42B 10/64 244/3.22
5,271,579 A * 12/1993 De Luca ..... F42B 10/14 102/348
5,320,304 A * 6/1994 Danielson ..... F42B 10/60 239/265.19
6,073,880 A * 6/2000 Voigt ..... F42B 10/64 244/3.24
6,637,699 B2 * 10/2003 Banks ..... F42B 10/64 244/3.21
6,796,526 B2 * 9/2004 Boehringer ..... B64C 13/40 244/78.1
7,108,223 B2 * 9/2006 Chasman ..... F42B 10/663 244/3.1
7,255,304 B2 * 8/2007 Ericson ..... F42B 19/01 244/3.24
7,428,870 B1 * 9/2008 Nedderman ..... B63B 1/32 102/399
8,026,465 B1 * 9/2011 Fraysse, Jr. ..... F42B 10/50 244/3.22
8,350,200 B1 * 1/2013 Hawkins ..... F42B 10/64 244/3.24

* cited by examiner

*Primary Examiner* — Brian M O'Hara
*Assistant Examiner* — Keith L Dixon
(74) *Attorney, Agent, or Firm* — Renner, Otto, Boisselle & Sklar, LLP

(57) ABSTRACT

A stability system for a vehicle moving through a fluid includes stabilizers each having a drive surface that follows the position of the fluid stream perceived by the vehicle. The movement of the drive surface positions control surfaces of the stabilizers, which are coupled to the drive surfaces by mechanical linkages. Lift forces on the drive surfaces provide the force that is used in positioning the control surfaces. The deflection of the control surfaces provides a force on the vehicle that affects stability of the vehicle, for instance in making an inherently unstable vehicle more stable. The stability system may work completely passively, without any active control, and without the need for power to operate it.

20 Claims, 3 Drawing Sheets

PASSIVE STABILITY SYSTEM FOR A VEHICLE MOVING THROUGH A FLUID

FIELD OF THE INVENTION

The invention is in the field of stability systems for vehicles moving through a fluid, such as air vehicles moving through air, or submersibles moving through water.

DESCRIPTION OF THE RELATED ART

Aerodynamic stabilization of flight vehicles is required to prevent loss of control or degraded performance. Stabilization is traditionally performed aerodynamically with fixed, large stabilizing aerodynamic surfaces located aft of the vehicle center of gravity. Active stabilization is achieved with high bandwidth inertial measurement units (IMUS) and control actuation systems. Such systems add to vehicle size, weight, and cost, and require power to be operational.

SUMMARY OF THE INVENTION

A passive stability system affects the stability of a vehicle, such as an air vehicle or a vehicle submersed in a liquid, without the need for power or active control. The stability system uses deflection of drive surfaces, which have a tendency to align with the fluid stream perceived by the vehicle, to position control surfaces, which provide a stabilizing moment on the vehicle. The drive surfaces and the control surfaces are operatively coupled together by one or more linkages, such that torque produced by lift forces on the drive surfaces are used to position the control surfaces.

According to an aspect of the invention, a stability system for a vehicle moving through a fluid includes: a drive surface pivotable relative to a fuselage of the vehicle; and a control surface pivotable relative to the fuselage. The drive surface passively pivots relative to the fuselage in response to changes in fluid flow external to and relative to the vehicle. The drive surface is mechanically coupled to the control surface by the mechanical linkage, such that pivoting of the drive surface relative to the fuselage causes pivoting of the control surface relative to the fuselage According to another aspect of the invention, a vehicle includes: a fuselage; a drive surface pivotable relative to the fuselage; and a control surface pivotable relative to the fuselage. The drive surface passively pivots relative to the fuselage in response to changes fluid flow external to and relative to the vehicle. The drive surface is mechanically coupled to the control surface such that pivoting of the drive surface relative to the fuselage causes pivoting of the control surface relative to the fuselage.

According to yet another aspect of the invention, a method of passively stabilizing a vehicle includes the steps of: passively aligning a drive surface of the vehicle toward an external fluid flow relative to the vehicle, by pivoting the drive surface relative to a fuselage of the vehicle; and passively positioning a control surface that is operatively coupled to the control surface by a linkage, using fluid forces on the drive surface, acting through the linkage, for pivoting the control surface. The positioning control surface provides stability to the vehicle.

According to still another aspect of the invention, a method of passively stabilizing a vehicle includes the steps of: passively aligning drive surfaces of the vehicle toward an external fluid flow relative to the vehicle, by pivoting the drive surfaces relative to a fuselage of the vehicle; and passively positioning control surfaces that are operatively coupled to the control surfaces by linkages, using fluid forces on the drive surfaces, acting through the linkages, pivot the control surfaces. The positioning control surfaces provides stability to the vehicle.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A stability system for a vehicle moving through a fluid includes stabilizers each having a drive surface that follows the position of the fluid stream perceived by the vehicle. The movement of the drive surface positions control surfaces of the stabilizers, which are coupled to the drive surfaces by mechanical linkages. Lift forces on the drive surfaces provide the force that is used in positioning the control surfaces. The deflection of the control surfaces provides a force on the vehicle that affects stability of the vehicle, for instance in making an inherently unstable vehicle more stable. The stability system may work completely passively, without any active control, and without the need for power to operate it.

Figure 1:
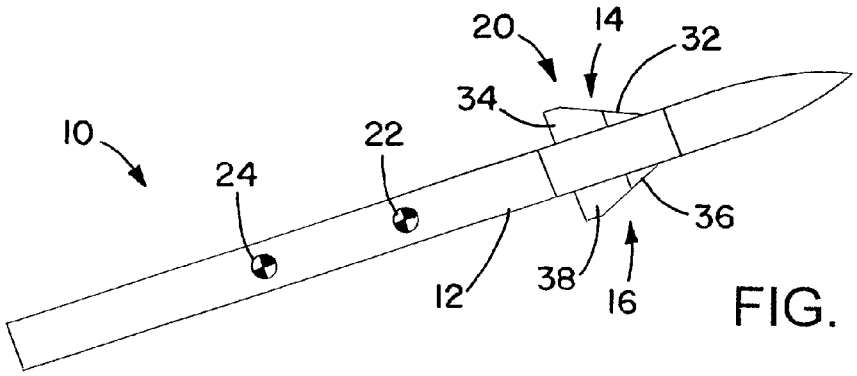
FIG. 1 is a side view of a vehicle according to an embodiment of the invention.

Referring initially to FIG. 1, a vehicle 10 that moves through a fluid, such as an air vehicle or an underwater vehicle, has a fuselage or other structure 12, and a pair of stabilizers 14 and 16 that are mechanically coupled to the fuselage 12 as part of a stability system 20. The vehicle 10 may be inherently unstable, with a center of pressure 22 of the vehicle 10 forward of a center of gravity 24 of the vehicle 10. The stabilizers 14 and 16 act to provide stability to the vehicle 10, passively providing stabilizing force to the vehicle 10 in response to changes in angle of attack of the vehicle 10.

The stabilizer 14 includes a drive surface 32 and a control surface 34. The stabilizer 16 includes a drive surface 36 and a control surface 38. As explained further below, the drive surface 32 is mechanically coupled to the control surface 34, and the drive surface 36 is mechanically coupled to the control surface 38. The drive surfaces 32 and 34 are configured to passively stay pointed in substantial alignment with the direction of free stream fluid flow relative to the vehicle 10. Thus the drive surfaces 32 and 36 change position as the angle of attack of the vehicle 10 changes. The drive surfaces 32 and 36 are mechanically coupled to the control surfaces 34 and 38, respectively. The coupling is such that the rotation or pivoting of the drive surfaces 32 and 36 in response to a change of vehicle angle of attack is used as a driving force to position the control surfaces 34 and 38 to produce a stabilizing moment on the vehicle 10. The stabilization may be completely passive, without any input from a pilot, without any action from an active control system, and without any sort of power input, relying simply on lift forces (aerodynamic forces in the case of an air vehicle).

Figure 2:
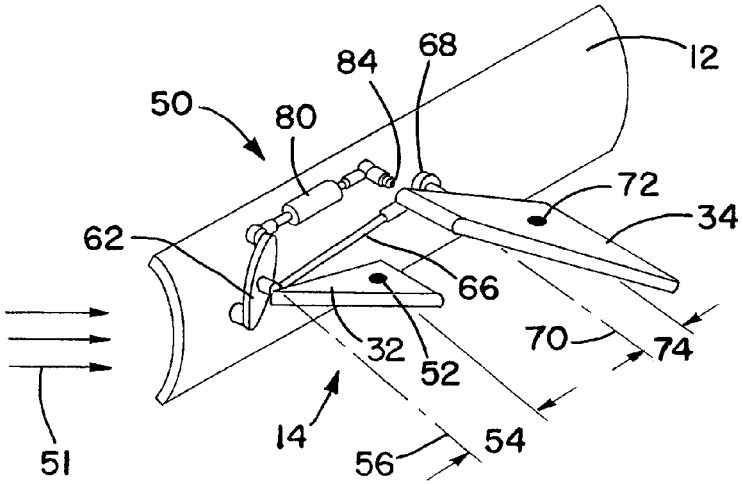
FIG. 2 is an first oblique view of a stabilizer of the vehicle of FIG. 1.
Figure 3:
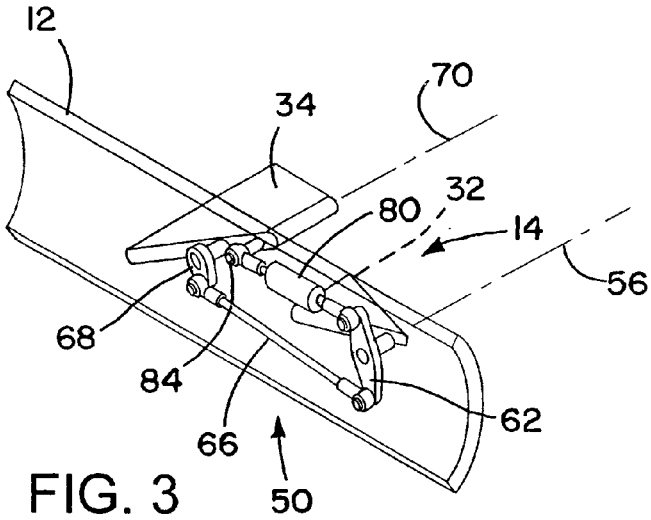
FIG. 3 is another oblique view of the stabilizer of FIG. 2.

With reference now in addition to FIGS. 2 and 3, details of the stabilizer 14 are described. The stabilizer 16, on an opposite side of the fuselage 12, may have a similar configuration and mode of operation. The mechanical connection between the drive surface 32 and the control surface 34 is a mechanical linkage 50. Lift forces on the drive surface 32 operate to maintain the drive surface 32 closely oriented with the direction of perceived external fluid motion 51 relative to the vehicle 10. As the vehicle 10 changes its angle of attack, a lift force is produced on the top or bottom surface of the drive surface 32 at a drive surface center of pressure 52. The drive surface center of pressure 52 is at a distance 54 from a drive surface axis or pivot point 56 about which the drive surface 32 can rotate relative to the fuselage 12. Thus any lift force produces a moment on the drive surface 32 that rotates the drive surface 32 back toward with the direction of perceived fluid motion 51 relative to the drive surface 32. That moment is used as the driving force, transmitted through the linkage 50, to also pivot or rotate the control surface 34 to produce a stabilizing force on the vehicle 10.

To that end, the drive surface 32 is connected to a bell crank 62 of the linkage 50. Rotation or pivoting of the drive surface 32 about the drive surface axis 56 rotates the bell crank 62 as well. The drive surface 32 is attached to a center part of the bell crank 62. An end of a connecting rod 66 is connected to one end of the bell crank 62. The other end of the connecting rod 66 is mounted on a crank pin of a crank 68. The control surface 34 rotates about the crankshaft of the crank 68, the rotation being about a control surface axis or pivot point 70. The crank 68 is rotated to turn the control surface 34, even against the moment on the control surface 34. This moment on the control surface 34 is provided by a lift force acting at a control surface center of pressure 72, at a distance 74 away from the control surface rotation axis 70. The distance 74 may be less than the corresponding distance 54 of the drive surface 32. This allows the drive surface 32 to provide a sufficient torque to dictate the position of the control surface 34. Even though the control surface 34 may have a greater surface area than the drive surface 32, the difference in the distances 54 and 74 may be such that for a given deflection angle of the surfaces 32 and 34, the moment provided by the lift forces for rotation of the drive surface 32 is greater than the moment from the control surface 34 opposing the rotation. The drive surface 32 thus acts as the driver to position the control surface 34, with the moment from a small deviation of the drive surface 32 from the relative fluid motion direction 51 used to produce a larger deviation of the control surface. The ratio of torque delivered by the drive surface 32 to the torque required to deflect the control surface 34 may vary based on the requirements of a given system. This ratio may be tailored over a large range, for example from 0.1 to 10.0, which gives the significant latitude in optimizing a system to meet any of a variety of different performance characteristics. A non-limiting range of the ratio of drive fin torque to control fin torque is from 2 to 5. A non-limiting range of ratio of drive surface to control surface size (area) is 0.2 to 0.4.

A damper 80 may be coupled to the other end of the bell crank 62, to damp motion of the linkage 50 in response to changes in angle of attack, or other events changing the perceived flow direction 51. The damper 80 is also coupled at its opposite end to a pin 84 that is fixed to the fuselage 12. The damper 80 may be any of a variety of inertia damping devices, for example devices filled with a viscous fluid or a ferrofluid to provide resistance to and dampening of motion. The damper 80 may be used to prevent oscillations in the movement of the surfaces 32 and 34, and the characteristics of the damper 80 may be selected to achieve desired characteristics in the operation of the linkage 50.

Similarly, other parts of the linkage 50 may be selected and configured to achieve desired operating conditions. The parts of the linkage 50, and the surfaces 32 and 34 themselves, may be configured to make the movement between the surfaces 32 and 34 proportional at any desired proportion, for example producing an angular deflection (or rotation or pivoting) of the control surface 34 that is greater in magnitude than the angular deflection of the drive surface 32 that drives movement of the control surface 34. To give one example, the surfaces 32 and 34 and the linkage 50 may be configured so that a deflection of the drive surface 32 produces twice that deflection in the control surface 34. More broadly, the surfaces 32 and 34 and the linkage 50 may be configured so that a deflection of the drive surface 32 produces at least 1.1 times the deflection in the control surface 34. The configuring may include suitable selection of any of a variety of features of the linkage 50 and the surfaces 32 and 34, including (for example) combinations of areas of the surfaces 32 and 34, the distances 54 and 74, the dimensions and layouts of the bell crank 62 and/or the crank 68, and/or the placement of the various parts relative to one another.

The linkage 50 in the illustrated embodiment is only one example of many possible suitable mechanical linkages (mechanical connections). Alternatives may include a wide variety of suitable elements, including for example rods, cranks, chains, gears, cables, pulleys, sliders, cams, springs, dampers, elastics, plastics, magnets, hydraulics, pneumatics, electromagnetic and/or hinges. It is also possible for there to be a mechanical connection between different stabilizers, for example with a single drive surface able to control multiple control surfaces, or with elements of different stabilizers linked in other suitable ways. The term "mechanical linkage" is used herein broadly to refer to passive (not actively driven by a powered system or by volitional control) linking together of movement of the drive surface and the control surface, without regard to the actual type of mechanism accomplishing the linkage.

In the illustrated embodiment stabilizer 14 has a triangular shape, with the drive surface 32 adjacent to the control surface 34 when the surfaces 32 and 34 are not deflected from their neutral central positions. The surfaces 32 and 34 alternatively may have any of a variety of other suitable shapes. In addition the surfaces 32 and 34 need not be adjacent to one another, and may be placed at longitudinal locations along the fuselage that are well separated. However, the illustrated configuration has the advantage of reducing drag when the surfaces 32 and 34 are coplanar, in their neutral central (undeflected) positions.

FIGS. 2 and 3 show the stabilizer 14 in operation. The drive surface 32 has pitched downward in response to a change in fluid flow perceived by the vehicle 10 (the apparent fluid flow relative to the vehicle 10), for example by a downward pitch of the nose of the vehicle 10. The drive surface 32 passively moves toward alignment with the direction 51 of fluid flow perceived by the vehicle 10, due to the drive surface axis 56 being so far forward on the drive surface 32. The drive surface 32 therefore may move to a location where it receives a minimal lift force, pitching up in the illustrated operation. The rotation or pivoting of the drive surface 32 about the drive surface axis 56 causes a larger deflection of the control surface 34, due to the mechanical action of the linkage 50. Thus the control surface 34 deflects less than the amount necessary to align itself with the perceived fluid flow direction 51. This results in the control surface 34 receiving an upward lift force, in the situation shown in FIGS. 2 and 3. Since the control surface 34 is forward of the center of gravity 24 (FIG. 1), this upward force on the vehicle 10 acts to pitch the nose of the vehicle 10 up, counteracting the downward pitching of the vehicle nose that initiated the chain of events. The action of the stabilizer 14 therefore tends to increase the stability of vehicle 10. If properly configured, with the control surface 34 having sufficient surface area, and deflecting far enough in response to deflections by the drive surface 32, an inherently-unstable vehicle can be transformed by use of the stabilizers 14 and 16 into a stable vehicle in which changes in pitch are automatically reduced without any need for active control. The operation of the stabilizer 14 is fully passive, without any active control required, and without any external power applied. The stabilizing affect is fully a function of the configuration of the surfaces 32 and 34, and the linkage 50 that allows the drive surface deflections to be multiplied to larger (perhaps proportionally larger) control surface deflections, which aids in stabilizing the vehicle 10.

The surfaces 32 and 34 may have shapes with top and bottom symmetry, for example having substantially flat top and bottom surfaces. Alternatively, the surfaces 32 and 34 may have other suitable cross-sectional shapes to take advantage of different fluid dynamic properties from highly viscous mediums to incompressible, supersonic and hypersonic flight regimes. A bias torque can be designed into the drive or control fin (camber for example) to induce a force at zero perceived fluid motion 51

The stabilizers 14 and 16, and their parts, may be made of any of a variety of suitable materials. Non-limiting examples include steel, aluminum, titanium, and composite materials.

In the illustrated embodiment the stability system 20 has two stabilizers 14 and 16, on opposite sides of the fuselage 12. More stabilizers may be added if desired, for example to have four stabilizers spaced around the fuselage 12, with two pairs of stabilizers providing stabilization in two perpendicular directions.

The fuselage 12 is shown as having a circular cross section. As an alternative the fuselage 12 may have any of a wide variety of other suitable shapes and/or configurations.

As noted above, the vehicle 10 may be any of a variety of vehicles that move in a fluid. The vehicle 10 may be an air vehicle, such as a missile, an airplane, or an unmanned aerial vehicle (UAV), to give a few broad examples. Alternatively the vehicle 10 may be a water vehicle, such as a submersible.

In one example, the vehicle 10 is a missile that is launched from an aircraft. It is desirable from a safety standpoint that the missile control system and any sort of active controller (like a computer) not be powered up during the launching. The stability system 20 does not require any sort of power or active control to achieve an increase in stability.

The vehicle 10 may have additional features not shown in the illustrated embodiment, for performing other functions. For example it may have control surfaces for steering, lift-producing surfaces such as wings for producing lift, fixed or movable fins, rudders, and/or canards for course stabilization, and/or a propulsion system, such as a rocket motor, jet engine, or propeller. Additional control surfaces can be in place before flight and/or can be deployable during flight. Further, the stabilizers 14 and 16 may be disconnected, such as being separated from the linkage, and/or repurposed for other functions during flight, if desired.

The stability system 20 is described above as a way to passively increase stability of the vehicle. As an alternative, the stabilizers 14 and 16 may be configured to passively decrease stability, such as by moving the control surfaces in opposite directions from the drive surfaces 32 and 36. Decreasing stability may have benefits, such as improving maneuverability of a vehicle. Terms such as "stabilizer" and "stability system" are used herein broadly to indicate change in stability, whether that change is an increase in stability or a decrease in stability.

Figure 4:
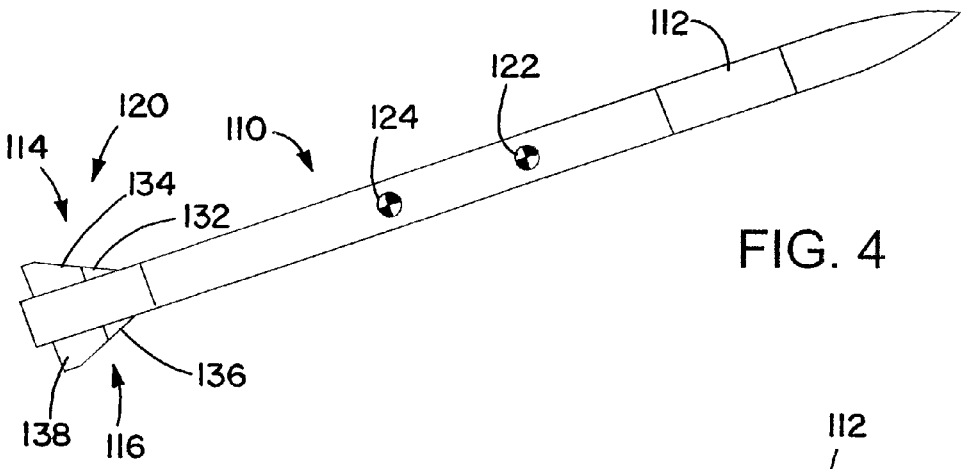
FIG. 4 is a side view of a vehicle according to another embodiment of the invention.
Figure 5:
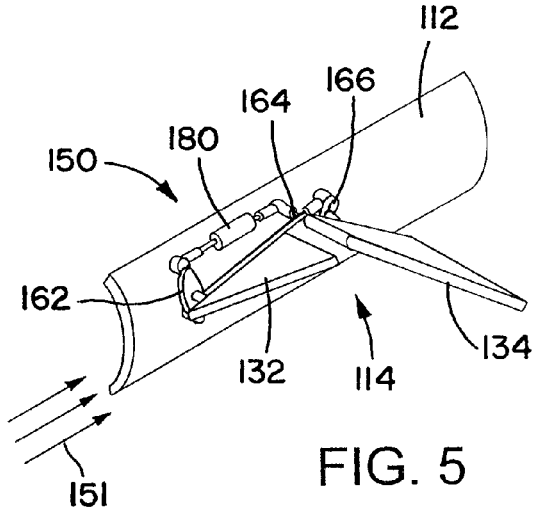
FIG. 5 is an first oblique view of a stabilizer of the vehicle of FIG. 4.
Figure 6:
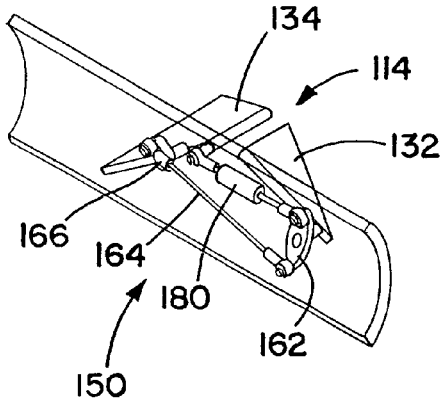
FIG. 6 is another oblique view of the stabilizer of FIG. 5.

FIGS. 4-6 show an alternate embodiment, a vehicle 110 that has stabilizers 114 and 116, parts of a stability system 120. The stabilizers 114 and 116 are coupled to a fuselage 112 aft of a center of gravity 124 of the vehicle 110, which in turn is aft of a center of pressure 122 of the vehicle 110. The stabilizers 114 and 116 act to provide additional stability to the vehicle 10, passively providing stabilizing force to the vehicle 110 in response to changes in angle of attack of the vehicle 110, or in response to other changes in perceived external fluid flow direction (flow relative to the vehicle 110).

Many aspects of the stabilizers 114 and 116 are similar to those of the stabilizers 14 and 16 (FIG. 1), and discussion of some similar features will be omitted below. However, since the stabilizers 114 and 116 are aft of the center of gravity 124, control surfaces 134 and 138 of the stabilizers 114 and 116 must pivot (rotate) in the opposite direction from drive surfaces 132 and 136 of the stabilizers 114 and 116. This is unlike the stabilizers 14 and 16, for which the drive surfaces 32 and 36 (FIG. 1) caused the control surfaces 34 and 38 (FIG. 1) to rotate in the same direction as the drive surfaces 32 and 36 (but at a greater magnitude).

This difference in rotation may be accomplished by differently configuring a mechanical linkage 150 for linking the surfaces 132 and 134. A similar mechanical linkage (not shown) links together the surfaces 136 and 138. With reference to FIGS. 5 and 6, the parts of the linkage 150 (a bell crank 162, a connecting rod 164, a crank 166, and a damper 180) may all be similar to corresponding parts of the link 50 (FIG. 2). The difference in rotation may be accomplished by changing the orientation of the crank 166 when connecting the rod 164, relative to how the crank 66 (FIG. 2) is connected to the rod 64 (FIG. 2). This change makes the control surface 134 rotate in the opposite sense from the rotation of the drive surface 132.

FIGS. 5 and 6 illustrate operation of the stabilizer 114. The nose of the vehicle 110 has pitched up, with the drive surface 132 pitching down in response, to move toward alignment with a direction 151 of the fluid flow relative to the vehicle 110. The movement of the drive surface 132 is transmitted through the linkage 150 to cause the control surface 134 to pitch upward. Again, as with the stabilizer 14 (FIG. 2), the magnitude of the deflection of the control surface 134 may be greater than the deflection of the drive surface 132. The lift on the vehicle 110 from the deflection of the control surface 134 produces a nose-down pitch, tending to stabilize the vehicle 110 with regard to pitch.

Figure 7:
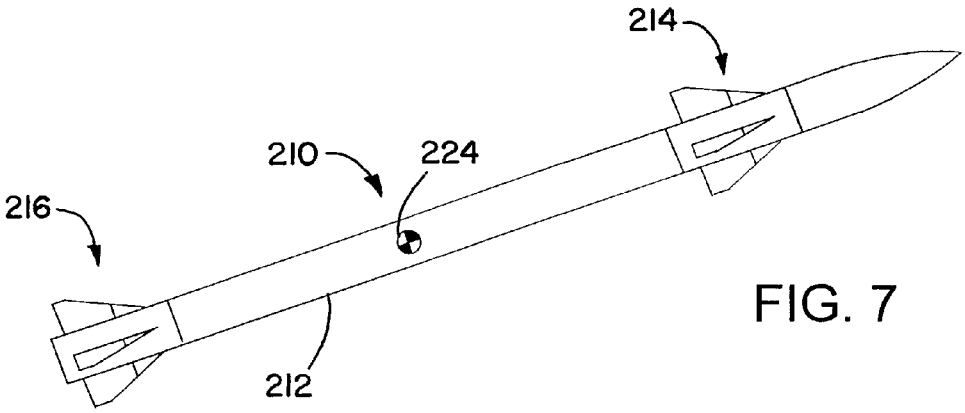
FIG. 7 is a side view of a vehicle of yet another embodiment of the invention.
Figure 8:
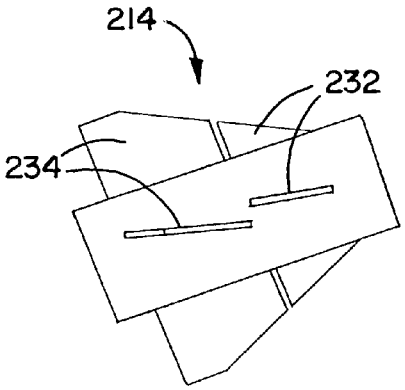
FIG. 8 is a side view showing details of forward stabilizers of the vehicle of FIG. 7.
Figure 9:
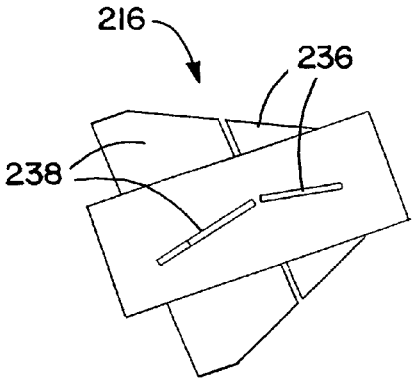
FIG. 9 is a side view showing details of aft stabilizers of the vehicle of FIG. 7.

The various variations discussed above for the vehicle 10 are applicable to the vehicle 110 as well. As a further alternative, a vehicle may have stabilizers both forward of and aft of its center of gravity. An example of this further alternative is the vehicle 210 shown in FIGS. 7-9. The vehicle 210 has four stabilizers 214 along a fuselage 212 forward of a vehicle center of gravity 224, and four stabilizers 216 aft of the center of gravity 224. The forward stabilizers 214 have respective drive surfaces 232 and control surfaces 234 that rotate in the same direction, as shown in FIG. 8 and in a manner similar to that described above with regard to the stabilizer 14 (FIGS. 1-3) of the vehicle 10 (FIG. 1). The aft stabilizers 216 have respective drive surfaces 236 and control surfaces 238 that rotate in opposite directions, as shown in FIG. 9 and in a manner similar to that described above with regard to the stabilizer 114 (FIGS. 4-6) of the vehicle 110 (FIG. 4). Other details of the vehicle 210 may be similar to those described above with regard to the vehicles 10 and 110.

The vehicles 10, 110, and 210 provide advantages in the ability to passively affect vehicle stability through simple mechanical linkages, without any volitional action or active control, and without requiring any power source. Such a stability system, using fluid forces for its driving power, provides stability control in situations where it would be undesirable to use active or powered stability control.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A stability system for a vehicle moving through a fluid, the system comprising:

a drive surface pivotable on a fuselage of the vehicle; and a control surface pivotable on the fuselage;

wherein the drive surface passively pivots on the fuselage in response to changes in fluid flow external to and relative to the vehicle; and wherein the drive surface is mechanically coupled to the control surface such that pivoting of the drive surface on the fuselage causes pivoting of the control surface on the fuselage, thereby passively providing a stabilizing moment on the vehicle.

2. The stability system of claim 1, wherein the pivoting of the control surface caused by pivoting of the drive surface is proportional to the pivoting of the drive surface.

3. The stability system of claim 1, wherein the pivoting of the control surface caused by pivoting of the drive surface is greater in magnitude than the pivoting of the drive surface.

4. The stability system of claim 1, wherein the pivoting of the control surface is in the same direction as the pivoting of the drive surface.

5. The stability system of claim 1, wherein the pivoting of the control surface is in the opposite direction from the pivoting of the drive surface.

6. The stability system of claim 1, further comprising a mechanical linkage that mechanically couples the drive surface and the control surface.

7. The stability system of claim 6, wherein the mechanical linkage includes a damper for damping movement of the surfaces.

8. The stability system of claim 1, further comprising:

an additional drive surface on an opposite side of the fuselage from the drive surface; and an additional control surface on an opposite side of the fuselage from the control surface;

wherein the additional drive surface passively pivots on the fuselage in response to changes in fluid flow external to and relative to the vehicle; and wherein the additional drive surface is mechanically coupled to the additional control surface such that pivoting of the additional drive surface on the fuselage causes pivoting of the additional control surface on the fuselage.

9. The stability system of claim 1, wherein the vehicle is inherently unstable, with a center of pressure of the vehicle forward of a center of gravity of the vehicle.

10. The stability system of claim 9, wherein the control surface is forward of the center of gravity of the vehicle.

11. The stability system of claim 9, wherein the control surface is aft of the center of gravity of the vehicle.

12. The stability system of claim 1, wherein a distance between a center of pressure of the drive surface and an axis of rotation of the drive surface is greater than a distance between a center of pressure of the control surface and an axis of rotation of the control surface.

13. The stability system of claim 1, wherein a surface area of the drive surface is less than a surface area of the control surface.

14. The stability system of claim 1, in combination with the fuselage, as parts of the vehicle.

15. A vehicle comprising:

a fuselage;

a drive surface pivotable on the fuselage;

a control surface pivotable on the fuselage; and a mechanical linkage;

wherein the drive surface passively pivots on the fuselage in response to changes in fluid flow external to and relative to the vehicle; and wherein the drive surface is mechanically coupled to the control surface by the mechanical linkage, such that pivoting of the drive surface on the fuselage causes pivoting of the control surface on the fuselage, thereby passively providing a stabilizing moment on the vehicle.

16. The vehicle of claim 15, wherein the vehicle is an air vehicle.

17. The vehicle of claim 15, wherein the vehicle is a water vehicle.

18. A method of passively stabilizing a vehicle, the method comprising:

passively aligning drive surfaces of the vehicle toward an external fluid flow relative to the vehicle, by pivoting the drive surfaces on a fuselage of the vehicle; and passively positioning control surfaces that are operatively coupled to the control surfaces by linkages, using fluid forces on the drive surfaces, acting through the linkages, pivot the control surfaces;

wherein the positioning control surfaces provides stability to the vehicle.

19. The method of claim 18, wherein some of the control surfaces are forward of a center of gravity of the vehicle; and wherein other of control surfaces are aft of the center of gravity of the vehicle.

20. The method of claim 19, wherein the pivoting of the drive surfaces and the pivoting of the some of the control surfaces are rotations in the same direction; and wherein the pivoting of the drive surfaces and the pivoting of the other of the control surfaces are rotations in opposite directions.

* * * * *